US006293432B1

(12) United States Patent
Hartwall

(10) Patent No.: US 6,293,432 B1
(45) Date of Patent: Sep. 25, 2001

(54) BAG SHAPED INNER LAYER IN THE FORM OF A SO-CALLED LINER INTENDED FOR USE TOGETHER WITH A CARRYING OUTER STRUCTURE WHEN TRANSPORTING AND STORING BULK GOODS

(75) Inventor: Peter Hartwall, Perstorp (SE)

(73) Assignee: Perstorp AB, Perstorp (SE)

( * ) Notice: Subject to any disclaimer, the term of this patent is extended or adjusted under 35 U.S.C. 154(b) by 0 days.

(21) Appl. No.: 09/446,919

(22) PCT Filed: Jul. 2, 1998

(86) PCT No.: PCT/SE98/01302

§ 371 Date: Dec. 30, 1999

§ 102(e) Date: Dec. 30, 1999

(87) PCT Pub. No.: WO99/02425

PCT Pub. Date: Jan. 21, 1999

(30) Foreign Application Priority Data

Jul. 7, 1997 (SE) ..... 9702608

(51) Int. Cl.[7] ..... B65D 77/06; B65D 90/04

(52) U.S. Cl. ..... 222/105; 222/93; 222/183; 222/481; 222/556; 222/564; 141/10; 141/313; 141/327

(58) Field of Search ..... 222/93, 105, 183, 222/478, 547, 556, 564; 141/10, 313, 325–327

(56) References Cited

U.S. PATENT DOCUMENTS

| | | | | |
|---|---|---|---|---|
| 3,143,249 | | 8/1964 | Merrill et al. | 222/105 |
| 4,850,506 | * | 7/1989 | Heaps, Jr. et al. | 222/93 |
| 5,050,775 | * | 9/1991 | Marquardt | 222/93 |

FOREIGN PATENT DOCUMENTS

| | | |
|---|---|---|
| 0326730 | 8/1989 | (EP) . |
| 2395913 | 1/1979 | (FR) . |
| 504693 | 4/1997 | (SE) . |
| 9324389 | 12/1993 | (WO) . |

* cited by examiner

*Primary Examiner*—J. Casimer Jacyna
(74) *Attorney, Agent, or Firm*—Stevens, Davis, Miller & Mosher, L.L.P.

(57) ABSTRACT

Bag shaped inner layer in the form of a so-called liner (1) intended for use together with a carrying outer structure (2) when transporting and storing bulk goods. The liner (1) is provided with a supporting member (11) towards which a liner bag is folded and/or rolled whereby a self supporting package is formed. The liner (1) is provided with a socket (12) for filling and a socket (13) for emptying.

9 Claims, 3 Drawing Sheets

BAG SHAPED INNER LAYER IN THE FORM OF A SO-CALLED LINER INTENDED FOR USE TOGETHER WITH A CARRYING OUTER STRUCTURE WHEN TRANSPORTING AND STORING BULK GOODS

The present invention relates to a bag shaped inner layer in the form of a so-called liner intended for use together with a carrying outer structure when transporting and storing fluid and particulate bulk goods.

Handling of bulk goods is separated from case goods by the fact that it can be poured, pumped or ladled while case goods most often is picked. Mineral water can serve as an example of the differences between the two types of goods. The mineral water could either be supplied in tanks for pumping and pouring which would be regarded as bulk handling, or in bottles or cans, which would be regarded as case handling. As examples of substances that can be bulk handled can be mentioned, fluid substances with various viscosity, particles, powders, grain, granulate or paste-like substances. Such substances can be further exemplified as chemicals for industrial use, semi-finished and finished products within the food industry, petro-chemical products such as oil, fuels and coal as well as plastic granulate.

A liner is used for separating the contained goods from the carrying outer casing. Such an outer casing might for example be constituted by a pallet container. Such pallet containers might for example include a pallet-shaped lower part made of wood and a upper part made of multi-layer cardboard. Among other known embodiments of such containers can be mentioned, box-shaped containers with a attached pallet bases made completely of metal or polymeric material. Such containers can also be made collapsible if the intended use is not too heavy. The reason for using a liner is, for instance, the hygienic aspects in the food industry. Other reason could be that the outer carrying structure i.e. the container itself, might be damaged by the contained substance, that the contained substance might be moist- or air-sensitive or due to migration problems.

A liner is advantageously given the shape of a completely closed bag, shaped as the inside of the carrying structure. It can also be provided with a filling- and an emptying-socket. The carrying structure might here be provided with a hole that matches the emptying socket.

One problem with the liners most common today is that they are rather difficult to use since they will have to be unfolded manually before they can be filled. All possible sockets will furthermore have to be oriented and attached at the proper place of the container. This is a most time consuming work and might even cause ruptures in the liner, leading to leaks, when the filling starts due to unintentional creases on the liner. The emptying might also be heavily obstructed if the emptying socket, of different reasons is slightly out of its proper position. This might cause that the couplings, used for emptying, do not to connect properly with the socket, which might cause a sudden, uncontrolled and unstoppable emptying of the liner. This will of course be inconvenient but could also be hazardous when the liner is used for transporting hazardous goods. Such goods could for example be flammable or oxidising substances, toxical substances, corrosive substances, carcinogenic and mutagenic substances.

It has, through the present invention, been made possible to solve the above mentioned problems whereby a less time consuming and more secure handling of the liner is achieved. The invention relates to a bag shaped inner layer in the form of a so-called liner, intended for use together with a carrying outer structure when transporting and storing bulk goods. The invention is characterised in that the liner is provided with a supporting member towards which a liner bag is folded and/or rolled. A self supporting package is hereby formed. The liner is further provided with a socket for filling and a socket for emptying. The supporting member is preferable provided with protective flaps which flaps are attached to the supporting member via folding lines so that they can be turned from an inner position where they protect the liner from being damaged during handling before the filling, to an outer, use-mode position.

The supporting structure is preferably adapted for being attached towards at least one of the side walls of the carrying outer structure by being provided with hooks, girders, flanges or the like which are designed to interact with corresponding attachment means on at least one of the side walls or on the lid of the carrying outer structure.

Such a carrying outer structure is suitably constituted by a so-called pallet container. Such a pallet container is suitably manufactured of a polymeric material, but might also be manufactured of metal.

The filling socket is preferably arranged at the upper part of the liner when attached in the carrying outer structure. The socket for emptying is preferably arranged at a position corresponding to an emptying recess at the bottom of the carrying outer structure. The supporting member is preferably provided with a guiding filling socket holder for the filling socket and a guiding emptying socket holder for the emptying socket.

The guiding filling socket holder is preferably arranged at the main part of the supporting member via a hinge. The self-supporting liner package can hereby be handled with at least the filling socket in a retracted, and thereby protected, position before the actual use as a container. The guiding emptying socket holder may also be arranged at the main part of the supporting member via such a hinge. This is especially suitable in cases where the emptying point is in the middle of the container bottom since this part of a pallet container is normally difficult to reach.

The filling socket is suitably provided with a tube shaped extension which runs vertically from the filling socket, along the side wall of carrying outer structure, on the inside of the liner bag, towards the bottom of the carrying outer structure. The filling and the inflating of the liner is thereby facilitated whereby build-up of unintended creases and pockets may be avoided.

The emptying socket suitably included a closing device in the form of a butterfly valve. The closing device includes a hoop-shaped valve seat and a valve which opens inwards by being movably attached to the valve seat via a hinge. The hinge is arrange at the inner edge of valve seat. The valve is opened by being forced inwards, into the liner bag so that the valve in the open position does not restrict the flow when emptying the liner.

The bag-shaped inner layer is folded in a special pattern before filling, which pattern allows it to unfold automatically to the desired shape when filled.

The collapsible container can also be provided with a device for heating. Such a device can for example be constituted by plates arranged on the base and/or sides of the container. The heating device is suitable supplied with electrical energy but can also be constituted by tubes with a heated circulating fluid or gas. Such a heating device is used when the content of the container is solid or highly viscous in normal room temperature. As an example of such possible contents can be mentioned chocolate, certain vegetable oils, certain waxes and resins.

A liner according the invention is delivered to the user in a folded state. The liner is protected by the flaps and the supporting member during the transport and handling before the actual use. The liner is easily arranged in the carrying outer structure by being placed standing with the supporting member towards one of the side walls of the carrying outer structure. The emptying socket is easily brought into position without any necessity for the fitter to climb, or reach down into the carrying outer structure since the supporting member can be used when guiding the emptying socket into position. The flaps and the guiding filling socket holder are then turned from the storing position to the use-mode position so that the liner bag itself is released and ready to use. Since the supporting member is standing, leaning against one of the side walls, it has to be attached in some way for not to turning over before the pressure of the content will keep it in place. This can be achieved by the use of interacting hooks etc, or by the use of so-called WELCRO-strips®, glue or clamps.

Containers for bulk handling are often provided with lids. Such lids could also be attached before the filling if they were provided with an opening or a hatch. The liner could then be kept in the desired standing position by letting the guiding filling socket holder interact with corresponding hooks or the like arranged on the lid.

The invention is illustrated further together with enclosed figures showing different embodiments of the invention whereby, FIG. 1 shows in cross-section, a part of a carrying outer structure 2 in the form of a pallet container with a liner 1 according to the invention.

Figure 1:
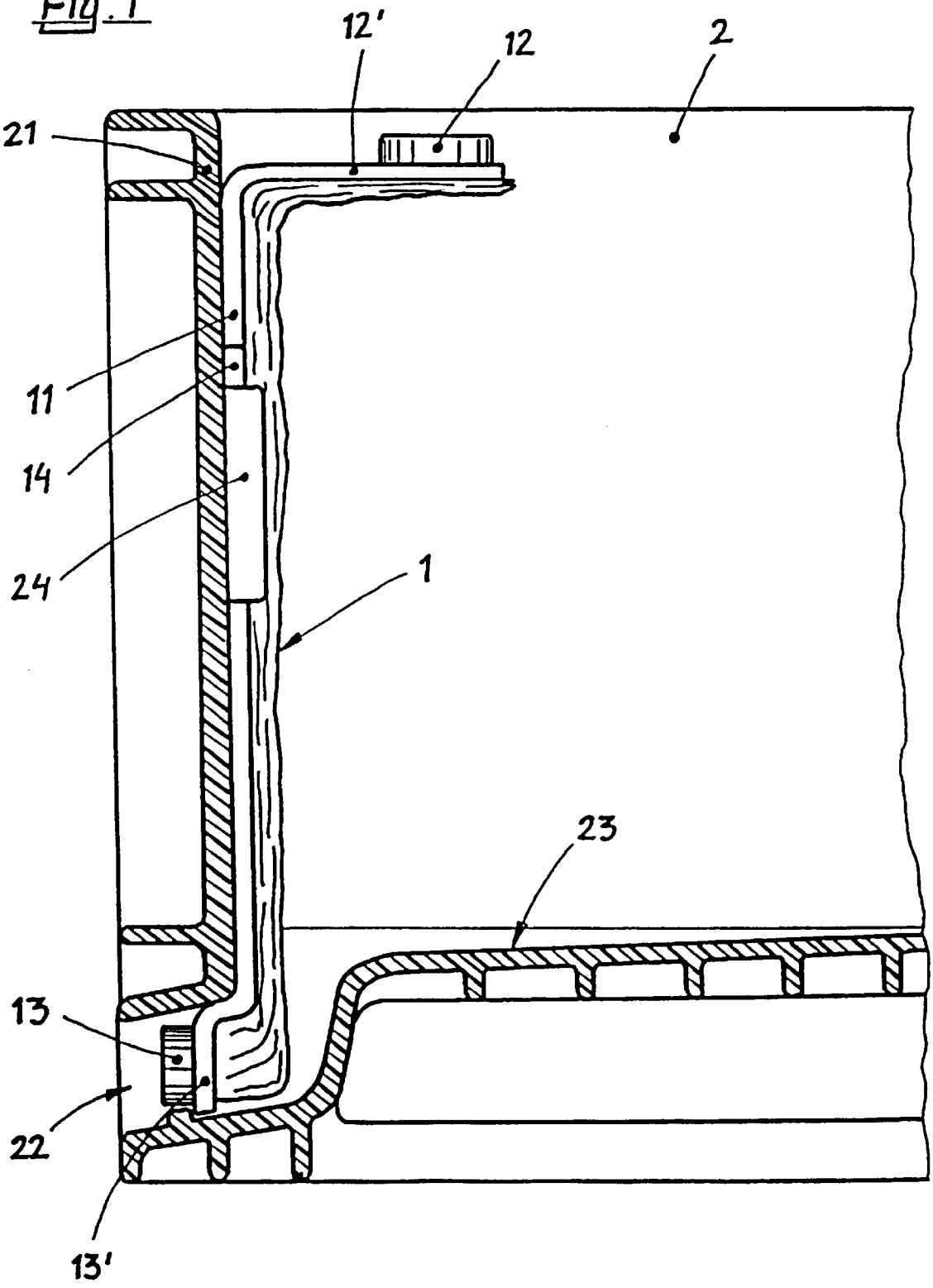

FIG. 1 shows in cross-section a part of a carrying outer structure 2 in the form of a pallet container. A liner 1 according to the invention has been arranged in the pallet container. The liner 1 is provided with a supporting member 11 towards which the liner bag itself has been folded. The supporting member 11 is provided with a guiding holder 12' for a filling socket 12 and a guiding holder 13' for an emptying socket 13. The supporting member 11 is further provided with hooks 14 which interacts with corresponding means 24 in the form of L-shaped profiles on the side wall 21 of the container. The liner 1, the filling and emptying sockets 12 and 13 respectively are thereby guided and kept in place before and during filling. The pallet container is provided with a recess 22 at the point where the bottom 23 and the side wall 21 meet. The recess 22 is adapted to receive the emptying socket 13. The liner bag is folded in a special pattern which allows it to self-inflate when being filled with the intended content.

Figure 2:
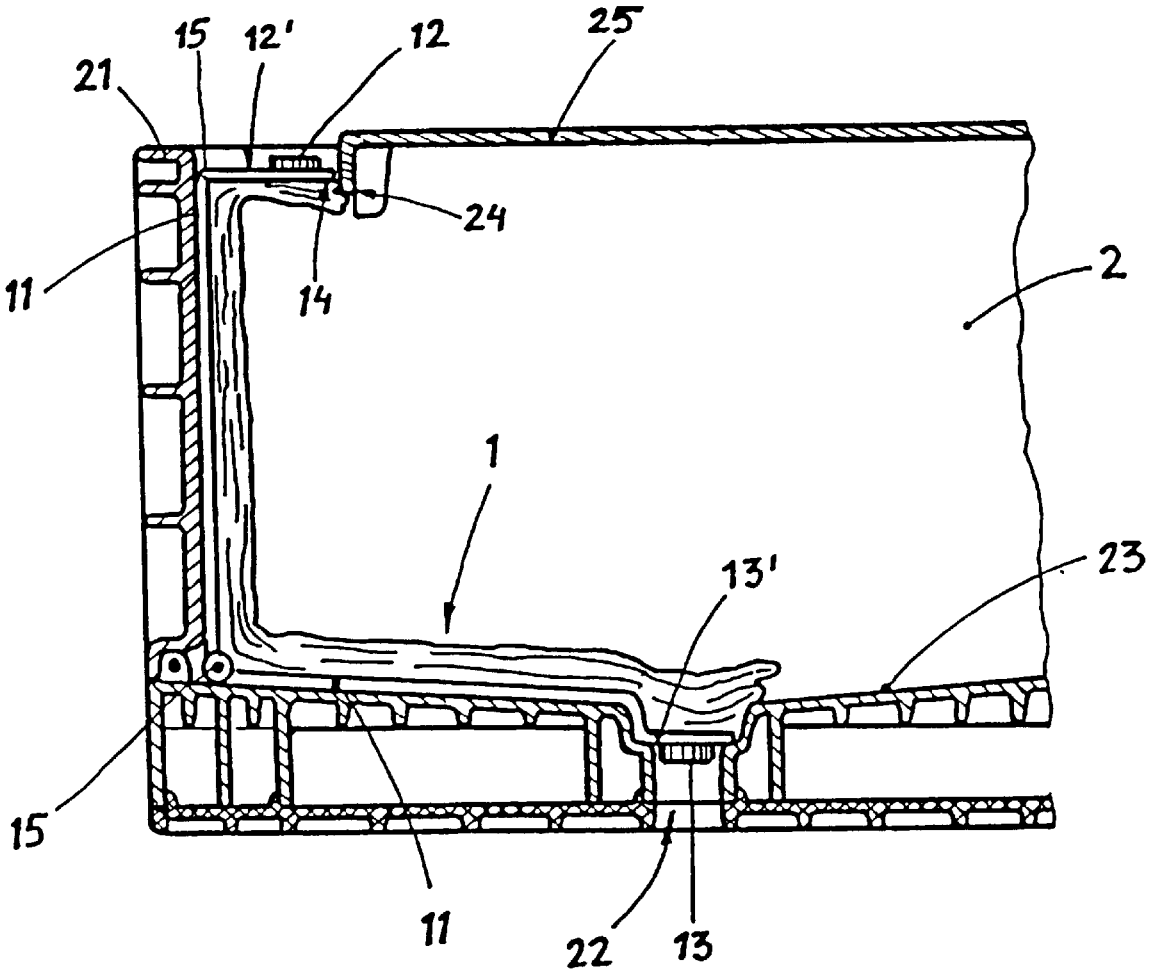
FIG. 2 shows a cross-section a second embodiment of a carrying outer structure 2 in the form of a pallet container with a liner 1 according to the invention.

FIG. 2 shows in cross-section a second embodiment of a carrying outer structure 2 in the form of a pallet container. A liner 1 according to a second embodiment of the invention has been arranged in the pallet container. The liner 1 is provided with a supporting member 11 towards which the liner bag itself has been folded.

The supporting member 11 is provided with a guiding holder 12' for a filling socket 12 and a guiding holder 13' for an emptying socket 13. The guiding holder 12' for the filling socket 12 is further provided with hooks 14 which interact with corresponding means 24 in the form of an L-shaped profile on a lid 25 arranged on the the container. The liner 1, the filling and emptying sockets 12 and 13 respectively are thereby guided and kept in place before and during filling. The supporting member 11 is further provided with a hinge 15 at the point where the bottom meets the side and between the main part of the supporting member 11 and the guiding holder 12' for the filling socket 12. This will facilitate the assembly of the liner 1 into the pallet container. The pallet container is at the centre of the bottom 23 provided with a recess 22 intended to receive the emptying socket 13. The liner bag is folded in a special pattern which allows it to self-inflate when being filled with the intended content.

Figure 3:
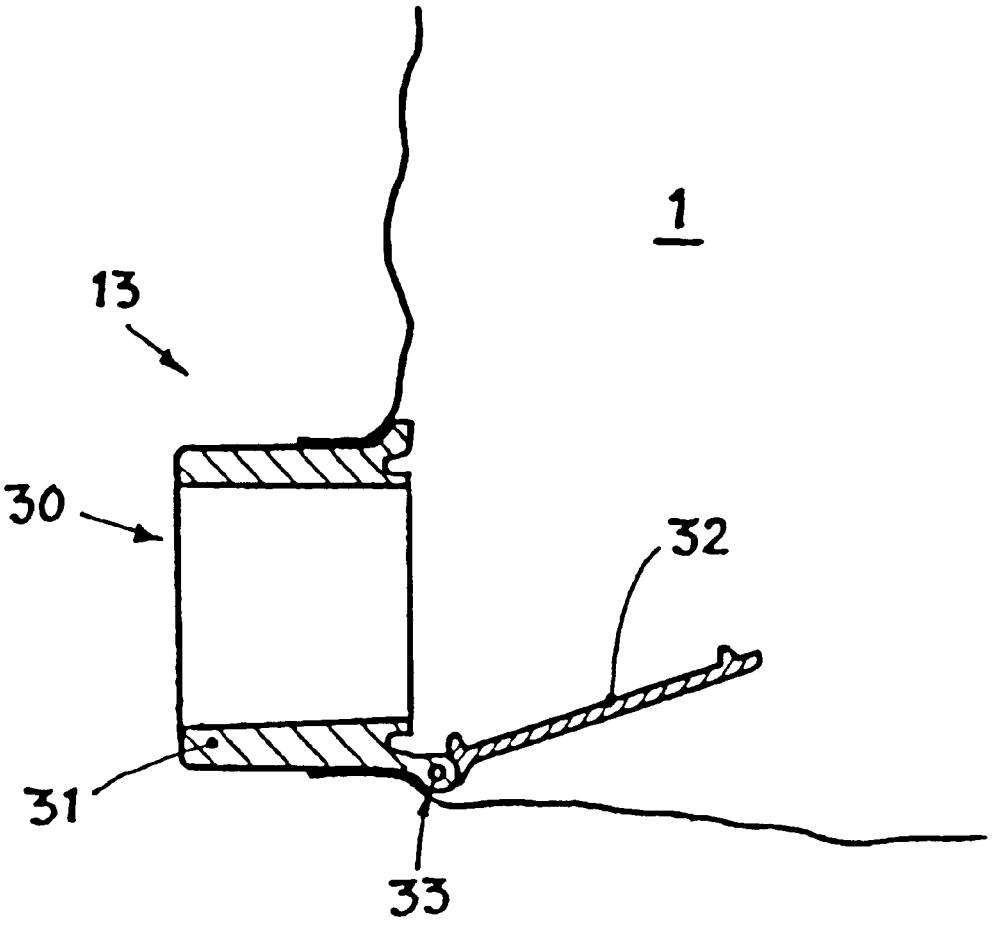
FIG. 3 shows in cross-section a part of liner 1 with an emptying socket 13.

FIG. 3 shows the parts around an emptying socket 13, of a liner 1 according to the invention. The emptying socket 13 includes a closing device 30 in the form of a butterfly valve. The closing includes a hoop-shaped valve seat 31 and a valve 32 which opens inwards by being movably attached to the valve seat 31 via a hinge 33. The hinge 33 is arranged at the inner edge of valve seat 31. The valve is opened by being forced or pushed inwards into the liner bag. The valve 32 will in the open position not restrict the flow when emptying the liner 1.

The invention is not limited by the embodiments shown since these can be varied in different ways within the scope of the invention.

What is claimed is:

1. A liner in the form of a bag shaped inner layer intended for use together with a carrying outer structure when transporting and storing bulk goods, the liner being provided with a supporting member towards which a liner bag is folded and rolled whereby a self-supporting package is formed, and that the liner is provided with a socket for filling and a socket for emptying, wherein the supporting member is provided with a guiding filling socket holder for the filling socket and a guiding emptying socket holder for the emptying socket, and at least the guiding filling socket holder is arranged at the main part of the supporting member via a hinge whereby the self-supporting liner package can be handled with at least the filling socket in a retracted, and thereby protected, position before the actual use as a container.

2. A liner in the form of a bag shaped inner layer intended for use together with a carrying outer structure when transporting and storing bulk goods, the liner being provided with a supporting member towards which a liner bag is folded and rolled whereby a self-supporting package is formed and, thus, the liner is provided with a socket for filling and a socket for emptying, wherein the filling socket is provided with a tube shaped extension which runs vertically from the filling socket, along the side wall of carrying outer structure, on the inside of the liner bag, towards the bottom of the carrying outer structure whereby the filling and the inflating of the liner is facilitated.

3. The liner according to claim 2, wherein the supporting member is provided with protective flaps which flaps are attached to the supporting member via folding lines so that they can be turned from an inner position, where they protect the liner from being damaged during handling before the filling, to an outer, use-mode position.

4. The liner according to claim 2, wherein the supporting structure is adapted for being attached towards at least one of the side walls of the carrying outer structure by being provided with at least one element selected from the group consisting of hooks, girders and flanges which are designed to interact with corresponding attachment means on at least one of the side walls or on the lid of the carrying outer structure.

5. The liner according to claim 2, wherein the filling socket is arranged at the upper part of the liner when attached in the carrying outer structure.

6. The liner according to claim 2, wherein the socket for emptying is arranged at a position corresponding to an emptying recess at the bottom of the carrying outer structure.

7. The liner according to claim 2, wherein the supporting member is provided with a guiding filling socket holder for the filling socket and a guiding emptying socket holder for the emptying socket.

8. The liner according to claim 2, wherein the bag-shaped inner layer is folded in a patter before filling, which pattern allows it to unfold automatically to the desired shape when being filled.

9. A liner in the form of a bag shaped inner layer intended for use together with a carrying outer structure when transporting and storing bulk goods, the liner being provided with a supporting member towards which a liner bag is folded and rolled whereby a self-supporting package is formed and, thus, the liner is provided with a socket for filling and a socket for emptying, wherein the emptying socket includes a closing device in the form of a butterfly valve, which closing device includes a hoop-shaped valve seat and a valve which opens inwards by being movably attached to the valve seat via a hinge which hinge is arranged at the inner edge of valve seat whereby the valve is opened by being forced inwards into the liner bag so that the valve in the open position does not restrict the flow when emptying the liner.

* * * * *